US006320310B1

(12) United States Patent
Imai et al.

(10) Patent No.: US 6,320,310 B1
(45) Date of Patent: Nov. 20, 2001

(54) IMAGE DISPLAY APPARATUS

(75) Inventors: Kanji Imai; Michiaki Watanabe; Hiroshi Aono; Yasuhiko Sakai, all of Osaka (JP)

(73) Assignee: Matsushita Electronics Corporation, Osaka (JP)

( * ) Notice: Subject to any disclaimer, the term of this patent is extended or adjusted under 35 U.S.C. 154(b) by 0 days.

(21) Appl. No.: 09/148,270

(22) Filed: Sep. 4, 1998

(30) Foreign Application Priority Data

Sep. 19, 1997 (JP) ..... 9-254594

(51) Int. Cl.[7] ..... H01J 1/62
(52) U.S. Cl. ..... 313/497; 313/495
(58) Field of Search ..... 313/495, 422, 313/482, 497, 496

(56) References Cited

U.S. PATENT DOCUMENTS

| | | | |
|---|---|---|---|
| 3,875,442 | | 4/1975 | Wasa et al. . |
| 4,145,633 | | 3/1979 | Peters . |
| 4,404,493 | | 9/1983 | Nonomura et al. . |
| 4,672,272 | | 6/1987 | Littwin . |
| 4,891,552 | | 1/1990 | Moriyama et al. . |
| 4,900,981 | | 2/1990 | Yamazaki . |
| 4,908,539 | | 3/1990 | Meyer . |
| 4,982,134 | | 1/1991 | Aono et al. . |
| 5,083,058 | * | 1/1992 | Nonomura et al. ..... 313/422 |
| 5,504,387 | | 4/1996 | Hamagishi . |
| 5,565,742 | | 10/1996 | Shichao et al. . |
| 5,652,083 | | 7/1997 | Kumar et al. . |
| 5,859,508 | | 1/1999 | Ge et al. . |
| 5,949,395 | | 9/1999 | Stevens et al. . |

FOREIGN PATENT DOCUMENTS

| | | |
|---|---|---|
| 0 172 089 | 2/1986 | (EP) . |
| 0 312 007 | 4/1989 | (EP) . |
| 0 316 871 A2 | 5/1989 | (EP) . |
| 0 404 022 | 12/1990 | (EP) . |
| 0 572 777 | 12/1993 | (EP) . |
| 0 614 209 | 9/1994 | (EP) . |
| 0 616 345 | 9/1994 | (EP) . |
| 0 628 982 | 12/1994 | (EP) . |
| 739 029 | 10/1996 | (EP) . |
| 0 896 358 | 2/1999 | (EP) . |

(List continued on next page.)

OTHER PUBLICATIONS

Communication from European Patent Office and attached Search Report (for Application No. 98115817.3–2208–), Nov. 13, 1998.
European Search Report.

*Primary Examiner*—Vip Patel
*Assistant Examiner*—Todd Reed Hopper
(74) *Attorney, Agent, or Firm*—Merchant & Gould P.C.

(57) ABSTRACT

In an image display apparatus comprising a fluorescent layer formed on the inner surface of a vacuum container, an electron emission source, and a supporting member sandwiched between the fluorescent layer and the electron emission source so that the fluorescent layer and the electron emission source are kept in parallel, a displacement preventing system is provided to prevent displacement of the electron beams emitted from the electron sources caused by the charging of the supporting member. More specifically, the supporting member may be composed of an insulating portion contacting with the electron emission source and a conducting portion contacting with the fluorescent layer. An electrode portion may be provided between the insulating portion and the conductive portion. Electron sources are arranged on the insulating substrate so that the electron beams emitted from the electron sources will be landed on the fluorescent layer with an equal pitch. The vacuum container provided with the supporting members can resist the atmospheric pressure and the supporting members will not affect adversely the images, and therefore good images can be obtained.

15 Claims, 13 Drawing Sheets

FOREIGN PATENT DOCUMENTS

| | | |
|---|---|---|
| 53-38260 | 4/1978 | (JP) . |
| 53-74357 | 7/1978 | (JP) . |
| 60-172152 | 9/1985 | (JP) . |
| 62-29046 | 2/1987 | (JP) . |
| 2-61946 | 3/1990 | (JP) . |
| 2-288052 | 11/1990 | (JP) . |
| 3-67444 | 3/1991 | (JP) . |
| 3-149728 | 6/1991 | (JP) . |
| 3-192639 | 8/1991 | (JP) . |
| 4-249048 | 9/1992 | (JP) . |
| 6-342635 | 12/1994 | (JP) . |
| 7-326206 | 12/1995 | (JP) . |
| 8-236044 | 9/1996 | (JP) . |
| 96/30926 | 10/1996 | (WO) . |
| 97/15912 | 5/1997 | (WO) . |

* cited by examiner

IMAGE DISPLAY APPARATUS

FIELD OF THE INVENTION

The present invention relates to an image display apparatus, and more particularly, relates to a thin image display apparatus used for a video camera and the like.

BACKGROUND OF THE INVENTION

Conventionally, cathode ray tubes mainly have been used as image display apparatuses for color televisions, personal computers and the like. However, in recent years, image display apparatuses have been required to be miniaturized and made lighter and thinner. In order to satisfy these demands, various types of thin image display apparatuses have been developed and commercialized.

Under these circumstances, various types of thin image display apparatuses have been researched and developed recently. In particular, liquid crystal displays and plasma displays have been developed actively. The liquid crystal displays have been applied to various types of products such as portable computers, portable televisions, video cameras, car-navigation systems and the like. Plasma displays have been used for products such as large-scale displays, for example, 20-inch-displays or 40-inch-displays.

However, there are several problems for the liquid crystal displays and the plasma displays. For instance, a liquid crystal display has a narrow visual angle and a slow response. Regarding a plasma display, only high brightness is obtainable and the consumed electricity is large. Then, an image display apparatus (hereinafter referred to as "a field emission image display apparatus" or "an image display apparatus") to which field emission, that is, a phenomenon in which electrons are emitted in a vacuum at room temperature, is applied, has attracted considerable attention. The field emission image display apparatus is of a spontaneous luminescent type, and therefore it is possible to obtain a wide visual angle and high brightness. Further, its basic principle (to illuminate a fluorescent substance with electron beams) is the same as that of a conventional cathode ray tube, and therefore, images with natural color and high reproduction can be displayed.

Published Unexamined Japanese Patent Application (Tokkai-Hei) 3-149728 discloses an example of such a field emission image display apparatus. The field emission image display apparatus that is driven under a vacuum condition from $1\times10^{-7}$ to $1\times10^{-8}$ torr should be produced generally by vacuum-sealing the inner part. Therefore, the thin field emission image display apparatus should have a structure to be resistant to the atmospheric pressure. For the purpose of obtaining a structure resistant to the atmospheric pressure, Tokkai Hei 3-149728 discloses a technique for providing a supporting member to the inner part of a field emission image display apparatus.

FIG. 12 is a schematic cross-sectional view showing a field emission image display apparatus according to a conventional technique. The field emission image display apparatus shown in FIG. 12 comprises an electron emission source 101 comprising an insulating substrate 101*a* provided thereon with plural electron sources 101*b*, a fluorescent layer 102 formed on the inner surface of the image display apparatus's panel to face the electron emission source 101, and supporting members 103 provided between the electron emission source 101 and fluorescent layer 102. The supporting members 103 are provided uniformly on the electron emission source 101 in order to prevent damage caused by outside pressure applied to the panel in the area between the electron emission source 101 and the fluorescent layer 102.

FIG. 13 is a schematic cross-sectional view showing another conventional field emission image display apparatus. Like the field emission image display apparatus shown in FIG. 12, this field emission image display apparatus comprises an electron emission source 201 comprising an insulating substrate 201*a* provided thereon with plural electron sources 201*b*, a fluorescent layer 202 and supporting members 203 formed between the electron emission source 201 and the fluorescent layer 202. The supporting members 203 are uniformly formed on the electron emission source 201 in order to prevent damage caused by the outside pressure applied to the panel in the area between the electron emission source 201 and the fluorescent layer 202. This image display apparatus is distinguishable from the former one in that the supporting members 203 composing the field emission image display apparatus in FIG. 13 are negatively charged while the supporting members 103 composing the field emission image display apparatus in FIG. 12 are positively charged.

An image display apparatus shown in FIG. 12 or 13 comprises the supporting members (103, 203) between the electron emission source (101, 201) and the fluorescent layer (102, 202), so that the field emission image display apparatus has a structure resistant to the atmospheric pressure. Electron beams (104, 204) are emitted from the electron sources (101*b*, 201*b*) formed with equal spacing on the insulating substrate (101*a*, 201*a*) and landed on predetermined positions of the fluorescent layer (102, 202), so that various images are displayed on the field emission image display apparatus. Various members required other than the above-identified ones for forming a field emission image display apparatus are omitted in FIGS. 12 and 13.

However, in the conventional field emission display apparatus in FIG. 12, the electron beams 104 emitted at an equal spacing will bend toward the supporting members 103 since the supporting members 103 are positively charged, and thus, the final landing positions of the electron beams 104 will not be spaced equally on the fluorescent layer 102. Similarly in the field emission image display apparatus shown in FIG. 13, the electron beams 204 emitted at an equal spacing will bend away from the supporting members 203 since the supporting members 203 are negatively charged, and thus, the final landing positions of the electron beams 204 will not be spaced equally on the fluorescent layer 202. As a result, the electron beams (104, 204) are deviated from the landing positions on the fluorescent layers (102, 202), and good images are difficult to obtain.

The supporting members (103, 203) composing the field emission image display apparatus have a predetermined thickness at the positions contacting with the fluorescent layer (102, 202). When this thickness exceeds a limit, it will be recognized as a horizontal line by someone watching the displayed images and the quality of the display images will be greatly lowered.

Furthermore in the conventional technique, plural supporting members (103, 203) are provided between the electron emission source (101, 201) and the fluorescent layer (102, 202). If the supporting members (103, 203) have different lengths, outside pressure will be applied only to the longer supporting members contacting with the fluorescent layer (102, 202), which may result in distortion or damage for the image display apparatuses.

SUMMARY OF THE INVENTION

In order to solve the above-mentioned problems, this invention aims to provide an image display apparatus having a structure resistant to the atmospheric pressure by providing a supporting member to the inner part of the image display apparatus, and that will not negatively affect the image, so that good images are provided.

In order to achieve the above aims, an image display apparatus of this invention comprises a fluorescent layer formed on the inner surface of a vacuum container whose interior is kept under vacuum, an electron emission source comprising an insulating substrate provided with electron sources arranged thereon, and a supporting member sandwiched between the fluorescent layer and the electron emission source. A displacement preventing system is provided inside the image display apparatus in order to prevent displacement of the electron beams emitted from the electron sources caused by the charging of the supporting member. In the image display apparatus provided with the displacement preventing system, the electron beams are not displaced by the charging of the supporting member, and thus, the images will not be negatively affected by forming the supporting member. As a result, an image display apparatus that has a structure resistant to the atmospheric pressure and displays a good image can be obtained.

It is preferable in the image display apparatus of this invention that the displacement preventing system comprises a conductive portion that is formed at a part of the supporting member near the fluorescent layer and contacts with the same layer. In such a preferable construction, the supporting member contacting with the fluorescent layer is the conductive portion and thus it is not charged, so that the electron beams will not be affected by the electric field in the vicinity of the fluorescent layer. As a result, displacement of the electron beams caused by the charged supporting member can be prevented efficiently.

In the preferred construction, the supporting member preferably has an electrode portion at the conductive portion opposite to the fluorescent layer and the electrode portion contacts with the conductive portion. In the preferable construction, the electrode portion can function as a divergent lens for the electron beams, so that the electron beams emitted from a position sufficiently separated from the supporting member can be deflected toward the supporting member. As a result, the electron beams are deflected toward the supporting member by using the electrode portion functioning as a divergent lens even if the electron sources sandwiching a formed supporting member are required to be arranged with more spacing compared to the other electron sources, so that the electron beams can be landed on the fluorescent layer with an equal pitch.

In the preferable construction, the supporting member preferably has an insulating portion between the electron emission source and the electrode portion. In the preferable construction, the fluorescent layer can be insulated electrically from the electron emission source with certainty. As the insulating portion is charged, it may deflect the electron beams. In order to prevent the deflection, the electron sources should be separated sufficiently from the supporting member depending on the deflection degree. In the preferable construction of this invention, however, the electron beams can be deflected toward the supporting member by using the electrode portion as a divergent lens as mentioned above. In addition, the area in the vicinity of the fluorescent layer provided with the conductive portion will not be affected by the electric field. As a result, the electron beams can be landed with an equal pitch on the fluorescent layer by properly controlling some factors such as the positions of the electron sources and of the electrode portion. As a result, continuous images with no influence of the supporting member can be displayed on the image display screen.

It is preferable in the image display apparatus of this invention that the electron sources are divided and arranged in a matrix.

It is further preferable that the electron sources are arranged on the insulating substrate so that the electron beams emitted from the electron sources are landed on the fluorescent layer with an equal pitch. In other words, the displacement preventing system prevents the electron beams from being displaced by the charging of the supporting member, and the electron sources can be arranged so that the electron beams will be landed with an equal pitch on the fluorescent layer by taking some factors such as the construction of the supporting member into consideration. As a result, good images free from the influence of the supporting member can be displayed.

It is also preferable in the image display apparatus of this invention that the electrode portion is formed wider than the insulating portion. In the preferable example, the area in the vicinity of the fluorescent layer will be still less affected by the electric field, and thus, a no-electric field region can be formed with certainty in the vicinity of the fluorescent layer. In addition, the function of the divergent lens formed by the electrode portion can be further increased. As a result, the electron beams can be landed on the fluorescent layer with an equal pitch in a relatively simple manner, and good images can be displayed.

It is preferable in the image display apparatus of this invention that a second electrode portion is provided at a part of the insulating portion near the electron emission source and the second electrode portion is wider than the insulating portion. In this preferable example, the electron beam accelerating field can be kept constant at a position separated from the insulating portion. Moreover, the electron beams can be separated sufficiently from the supporting member so that the charging of the supporting member (the insulating portion) caused by the electron beams can be minimized.

It is also preferable in the image display apparatus that voltage can be applied independently to the plural second electrode portions respectively. In the preferable example, the extension of the initial speed of the electron beams, the vectors of the initial speed of the electron beams etc. can be controlled by independently controlling the voltage applied to the respective second electrode portions, so that the disorder in uniformity of the image displayed in the vicinity of the supporting member can be controlled while observing the images. Therefore, the deviation of the beam landing caused by the deviation of the electron sources (deviations caused by manufacturing error etc.) can be corrected in a simple manner. As a result, the electron beams can be landed on the fluorescent layer with an equal pitch in a comparatively simple manner.

It is also preferable in the image display apparatus of this invention that the conductive portion is tapered and a part of the conductive portion contacting with the fluorescent layer is shaped narrower than the opposite part. In this preferable example, as the conductive portion composing the supporting member is tapered, it is possible to minimize the chance that those who observe the displayed image will recognize the part at which the conductive portions and fluorescent layer are contacted with each other. As a result, the image display apparatus of this invention can provide good images without shielding the display image.

It is also preferable in the image display apparatus of this invention that the supporting member is resilient. In this preferable example, stress is prevented from being focused on one point due to the predetermined resilience even if the supporting members are varied in length. Therefore, distortion and cracking of the image display apparatus can be prevented.

It is further preferable in forming the resilient supporting member that the electrode portion is resilient. In the preferable example, the electrode portions can compensate the variation in length of the portions composing the supporting members other than the electrode portions. It is also preferable in forming the resilient supporting members that the conductive portions are resilient. In this preferable example, the conductive portions can compensate the variation in length of the portions composing the supporting members other than the conducting portions. It is further preferable in forming the resilient supporting members that the insulating portions are resilient. In this preferable example, the insulating portions can compensate the variation in length of the portions composing the supporting members other than the insulating portions.

It is preferable in the image display apparatus of this invention that the supporting members are arranged with a higher density at the center of the image display apparatus screen. In this preferable example, the portion at the center of the screen, on which stress caused by the atmospheric pressure is focused, can be supported with certainty, and an image display apparatus having a thin and large screen can be provided.

An image display apparatus of this invention comprises a fluorescent layer formed on the inner surface of a vacuum container whose interior is kept under vacuum, an electron emission source having an insulating substrate provided with electron sources arranged thereon, and a supporting member sandwiched between the fluorescent layer and the electron emission source, in which the supporting member comprises a conducting portion to contact with the fluorescent layer. In the image display apparatus, the supporting member contacting with the fluorescent layer is a conductive portion and will not be charged, so that the electron beams will not be affected by the electric field in the vicinity of the fluorescent layer. Therefore, the electron beams are effectively prevented from displacement caused by the charging of the supporting member. As a result, providing supporting members will not adversely affect the images, and thus, an image display apparatus having a structure resistant to the atmospheric pressure and providing a good image display can be obtained.

DETAILED DESCRIPTION OF THE INVENTION

The invention will be further described below referring to the FIGS. 1–11.

First Embodiment

Figure 1:
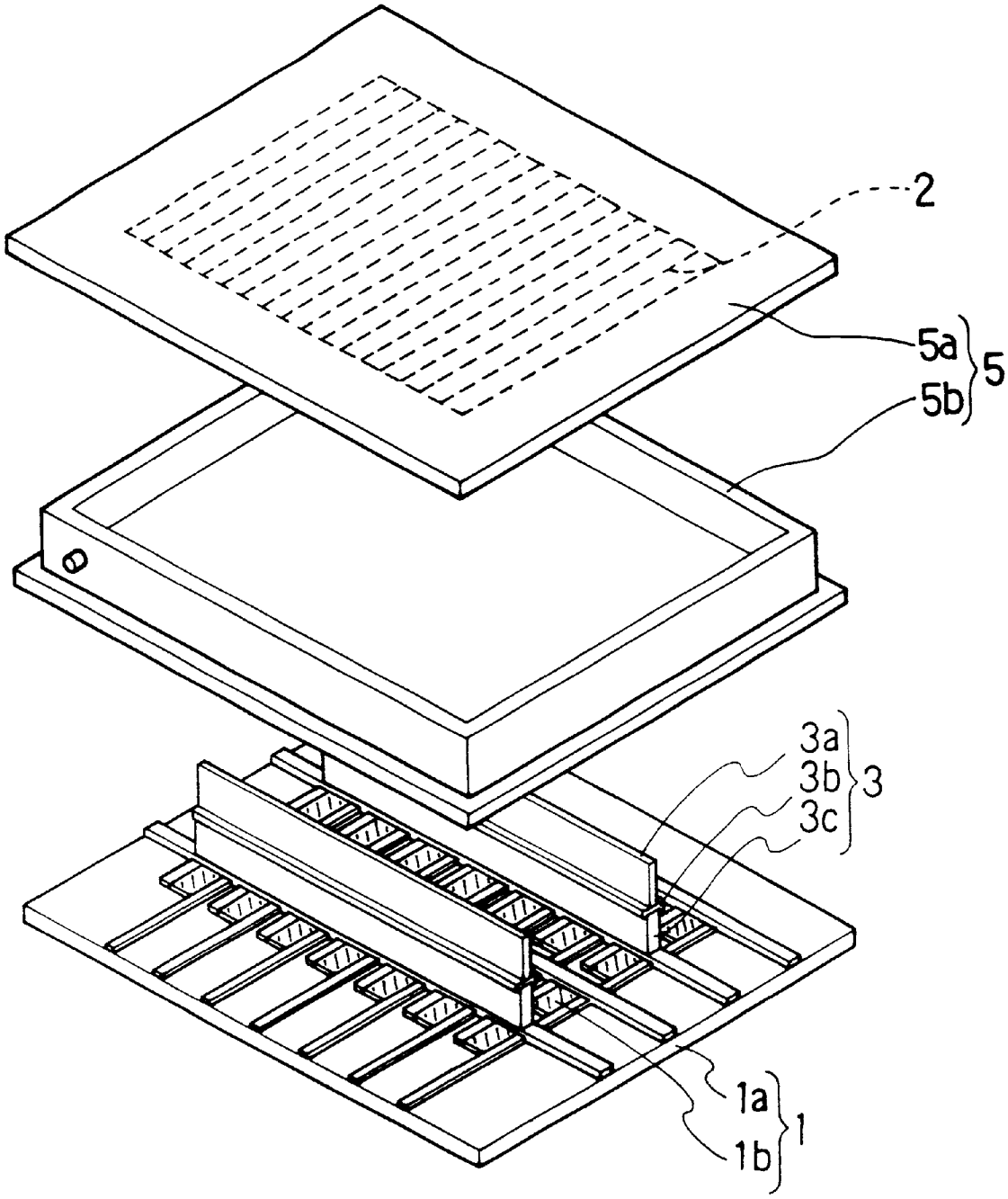
FIG. 1 is a perspective exploded view showing an image display apparatus in the first embodiment of this invention.
Figure 2:
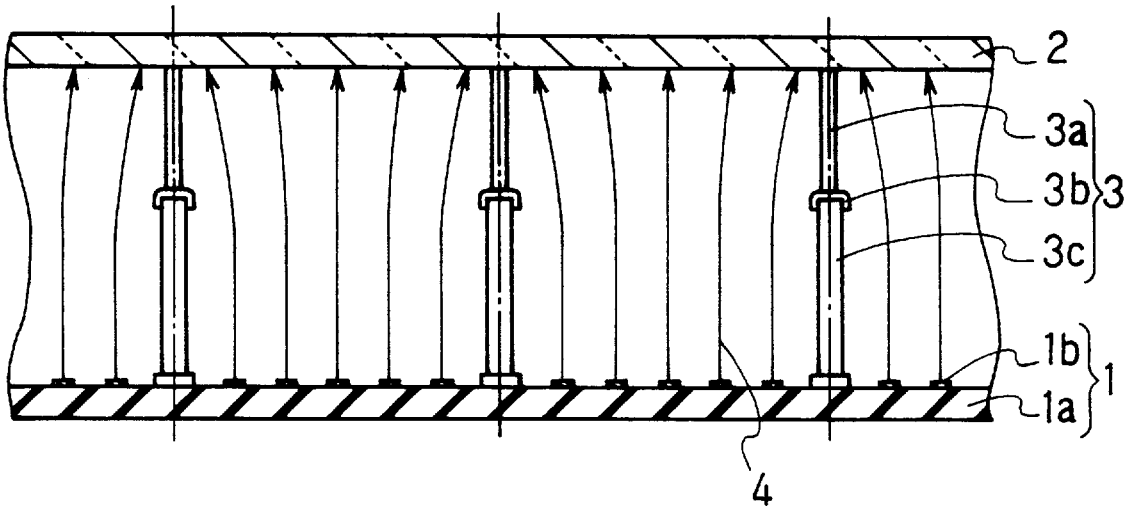
FIG. 2 is a cross-sectional view showing the schematic construction of the image display apparatus of FIG. 1.

FIG. 1 is a perspective exploded view showing an image display apparatus in the first embodiment of this invention. FIG. 2 is a cross-sectional view showing the schematic construction of the image display apparatus of FIG. 1. As shown in FIGS. 1 and 2, an image display apparatus in this embodiment comprises an electron emission source 1 formed by arranging plural electron sources 1*b* in a matrix on an insulating substrate 1*a*, a fluorescent layer 2 formed on the inner surface of a panel 5, that displays an image by being excited by electron beams 4 emitted from the electron sources 1*b*, and supporting members 3 formed between the electron emission source 1 and the fluorescent layer 2. This image display apparatus is provided with a displacement preventing system (conductive portions 3*a*) to prevent displacement of the electron beams 4 emitted from the electron sources 1*b* caused by the charging of a supporting member 3. A vacuum container is formed from the insulating substrate 1*a* and a panel 5, and the inside of the image display apparatus is kept under a vacuum of about $10^{-6}$ to $10^{-8}$ torr. As shown in FIG. 1, the fluorescent layer 2 in this embodiment is formed on the inner surface (vacuum side) of the panel plate member 5*a* by providing the plate-like panel image display screen (panel plate member 5*a*) and the surrounding wall portion (panel frame member 5*b*)as separate pieces. The plate-like panel image display screen (panel plate member 5*a*), the surrounding wall (panel frame member 5*b*) and the insulating substrate 1*a* are stuck together at the same time so that the vacuum container for the image display apparatus is formed.

Any type of an electron emission source 1 can be used as long as it can emit electron beams 4 in a matrix. For example, an electron emission source, which is composed of a surface conductive element composed of a thin film of $SnO_2$(Sb) or a thin film of Au and the like or a thin film of other materials, a microchip type electric field electron mission element such as Spindt type (microchip cathode of field emission type invented by Spindt), an electric field electron emission element having a MIN type structure or a similar structure or a cold cathode ray element composed of an electron emission material which is a carbon material such as diamond, graphite, DLC (Diamond Like Carbon) and the like, may be used. The electron sources 1*b* are arranged at a predetermined spacing on the insulating substrate 1*a* so that the respective electron beams 4 emitted from the respective electron sources 1*b* will be landed with an equal pitch on the fluorescent layer 2. In order to leave the space for the supporting members 3, larger spacing is provided between the electrode sources 1*b* at the positions to sandwich the supporting members 3 compared to the other positions in the insulating substrate 1*a*.

The fluorescent layer 2 is formed by applying (e.g., coating) a fluorescent substance on the inner surface of the panel. The fluorescent substance emits light by being irradiated with electron beams emitted from the electron emission source 1. In coating a fluorescent substance on the panel inner surface, in order to provide a fluorescent layer 2 which can display a colored image, the fluorescent substance is coated in numerous strips on the panel inner surface in order of, for instance, red (R), green (G), and blue (B). The stripe-arranged fluorescent substance can be provided by some methods such as photolithography as in a usual case for forming a fluorescent surface for a cathode ray tube, or a screen-stencil.

Figure 3:
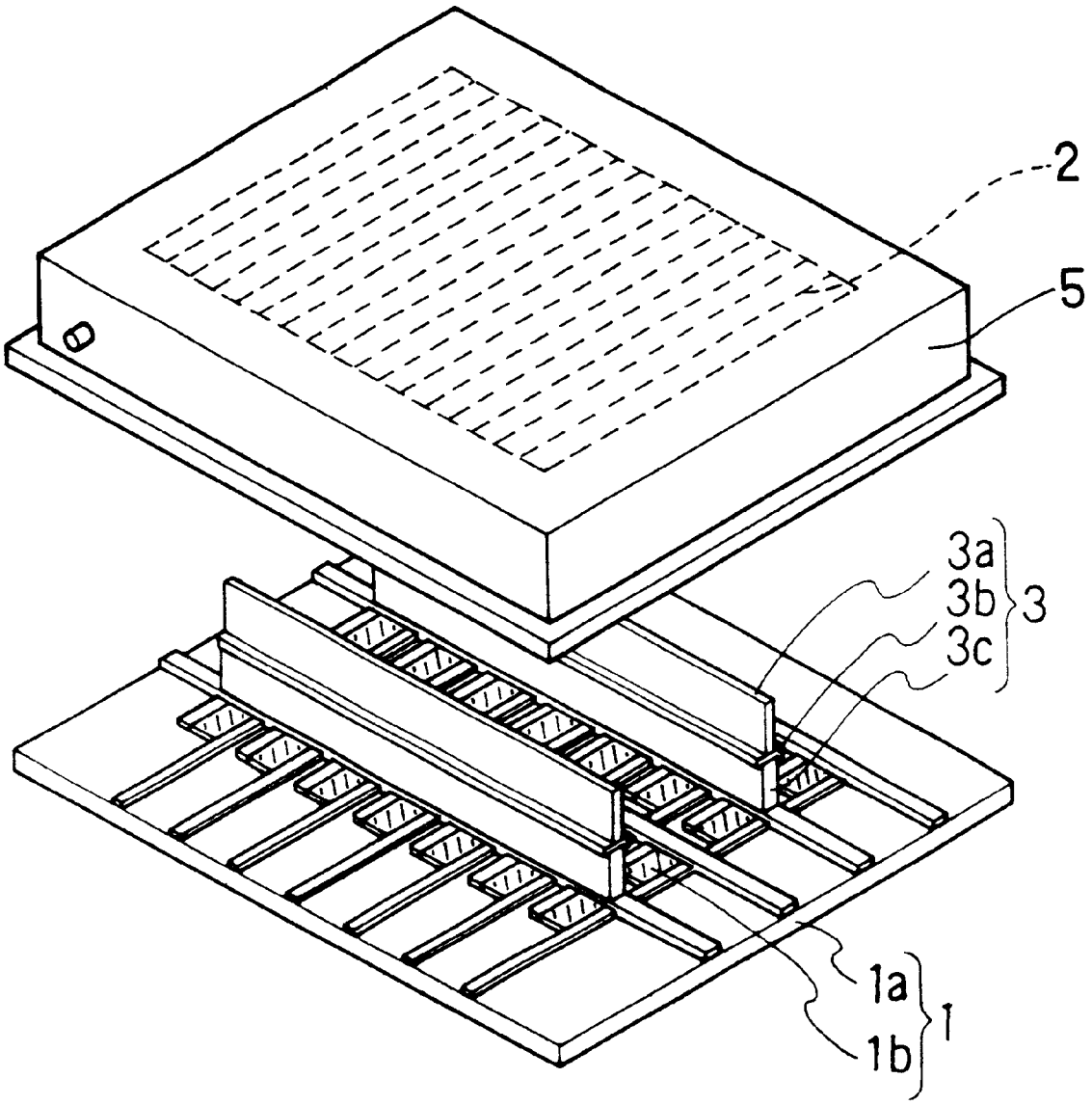
FIG. 3 is a perspective exploded view showing an image display apparatus formed by using a glass panel different from that of FIG. 1.

As shown in FIG. 3, the glass panel 5 may have a box-shape in which the plate-like panel image display screen is incorporated with the surrounding wall portion. When forming a fluorescent surface (a fluorescent layer 2) on this glass panel 5, however, the wall portion surrounding the panel will be an obstacle in the printing step. Some methods can be taken to avoid the problem, for instance, a method for transferring the fluorescent layer by applying heat or pressure after forming the fluorescent surface on a resin sheet; or forming a fluorescent layer on a relatively thin glass plate and sticking it to the panel's inner surface.

A supporting member 3 comprises a conductive portion 3*a* as a displacement preventing system, an electrode portion 3*b* to direct the electron beams 4 to the predetermined positions on the fluorescent layer 2, and an insulating portion 3*c* to insulate the electron emission source 1 from the electrode portion 3*b*. The supporting member 3 is composed by connecting the conductive portion 3*a* and the insulating portion 3*c* via the electrode portion 3*b*, and formed between the electron emission source 1 and the fluorescent layer 2 so that the conductive portion 3*a* will contact with the fluorescent layer 2 while the insulating portion 3*c* will contact with the electron emission source 1.

The glass panel 5 is made of a transparent material such as glass, since it is required that light emitted from a fluorescent layer to be observed from outside of the glass panel 5 in order to function as an image display apparatus. However, it is not required that the whole surface of the glass panel be transparent, but only the part of the glass panel 5 which contacts with the fluorescent layer 2 is transparent (in FIG. 1, the panel plate member 5*a*, and in FIG. 3, the upper area with largest surface). According to the construction, the image display apparatus of this invention can resist the outside pressure sufficiently even if the glass panel is not so thick. As a result, the image display apparatus can be made lighter while having a flat structure.

As mentioned above, FIG. 2 is a cross-sectional view showing the schematic construction of the image display apparatus of FIG. 1. In FIG. 2, electron beams 4 are emitted appropriately from respective electron sources 1*b* composing the electron emission source 1. Each electron beam 4 is landed at the predetermined position on the fluorescent layer 2, and various images are displayed on the image display apparatus. The following is an explanation about the operation and effects of the image display apparatus in this embodiment, referring to FIG. 2.

A supporting member 3 composing the image display apparatus in this embodiment is sandwiched between the electron emission source 1 and the fluorescent layer 2 so that the conductive portion 3*a* will contact with the fluorescent layer 2 while the insulating portion 3*c* will contact with the electron emission source 1. As the conductive portion 3*a* composes the supporting portion 3 at the part near the fluorescent layer 2, the potential is equal at the fluorescent layer 2, the conductive portion 3*a* and the electrode portion 3*b*, and the supporting member 3 (conductive portion 3*a*) will not be charged in the vicinity of the fluorescent layer 2. Therefore, the electron beams 4 will not be affected by the electric field in the vicinity of the fluorescent layer 2. In this embodiment, the electron sources 1*b* to sandwich each supporting member 3 are arranged to be separated from the supporting member 3 as much as possible so that the electron beams will be protected from the influence of the charged insulating portion 3*c*. Furthermore in this embodiment, the electrode portion 3*b* composing the supporting member 3 functions as a divergent lens to the electrode beams 4, and thus, the emitted electron beams can be deflected to the supporting member even if the electron sources 1*b* are arranged at the positions separated from the charged insulating portion 3*c*.

As a result, the image display apparatus of this embodiment can land the electron beams on the fluorescent layer with an equal pitch by appropriately controlling the positions of the electron sources 1*b* arranged on the insulating substrate 1*a* and the positions of the electrode portions 3*b* composing the supporting members 3. Therefore, continuous picture images free from influences by the supporting members 3 can be displayed on the image screen.

Second Embodiment

Figure 4:
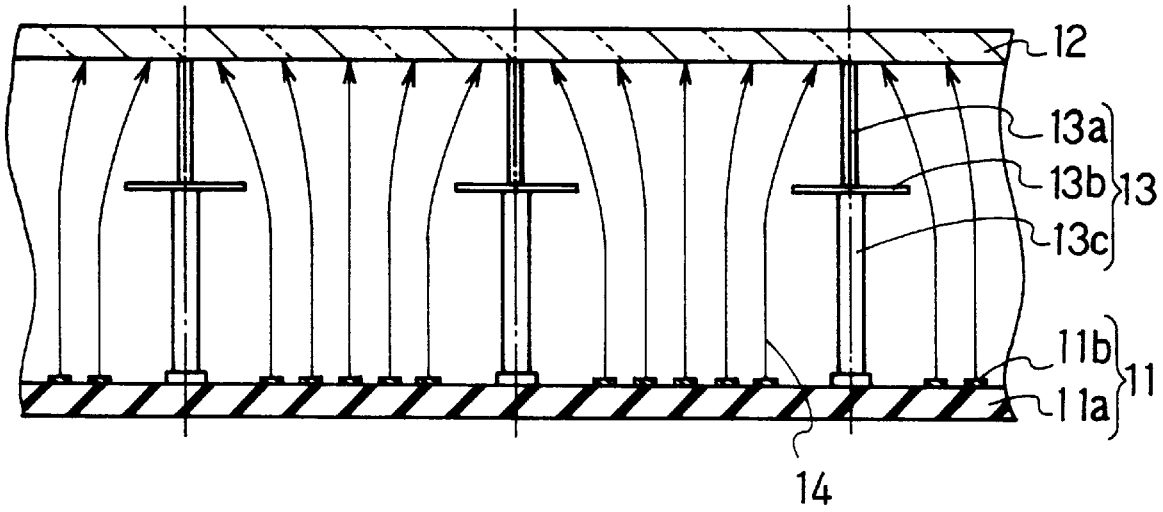
FIG. 4 is a cross-sectional view showing the schematic construction of an image display apparatus in the second embodiment.

FIG. 4 is a cross-sectional view showing the schematic construction of an image display apparatus in the second embodiment. The basic construction of a display of the embodiment is the same as that of the first embodiment, except that the structure of the supporting members and the arrangement of the electrode sources are distinguishable from the first embodiment.

A supporting member 13 composing the image display apparatus in this embodiment comprises a conductive portion 13*a*, an electrode portion 13*b* and an insulating portion 13*c*. The supporting member 13 is formed by connecting the conductive portion 13*a* and the insulating portion 13*c* via the electrode portion 13*b*, and sandwiched between the electron emission source 11 and the fluorescent layer 12 so that the conductive portion 13*a* will contact with the fluorescent layer 12 while the insulating portion 13*c* will contact with the electron emission source 11. Unlike the electrode portion in the first embodiment, the electrode portion 13*b* of this embodiment is formed to project in the direction parallel to the image display screen. The thus formed electrode portion 13*b* has a ribbon-shape when viewed from above. In this embodiment, in which the electrode portion 13*b* made wider, apertures through which the electron beams 14 pass (the spacing between adjacent electrode portions 13*b* ) become small, and the spacing of the electron sources 11*b* arranged on the insulating substrate 11*a* is controlled to correspond to the spacing between the electrode portions 13*b*. More specifically, the electron sources 11*b* sandwiching the supporting members 13 are arranged to be further separated from the supporting members 13 compared to the case of the first embodiment.

In this embodiment in which the above-mentioned electron emission source 11 and supporting members 13 are used to compose the image display apparatus, the area in the vicinity of the fluorescent layer 12 will be less affected by the electric field present in the vicinity of the electron emission source 11, so that a no-electric field region in the vicinity of the fluorescent layer 12 can be provided with further certainty. It can also increase the function of the divergent lens formed by the electrode portion 13*b*, and the influence of the (charged) insulating portion 13*c* on the electron beams 14 can be further decreased compared to the first embodiment. As a result, the electron beams 14 can be landed with an equal pitch on the fluorescent layer 12 in a relatively simple manner by appropriately controlling some factors such as the positions of the electron sources 11*b* arranged on the insulating substrate 11*a*, and the positions and size of the electrode portion 13*b* composing the supporting members 13. Therefore, good images can be obtained in the image display apparatus of this embodiment.

Third Embodiment

Figure 5:
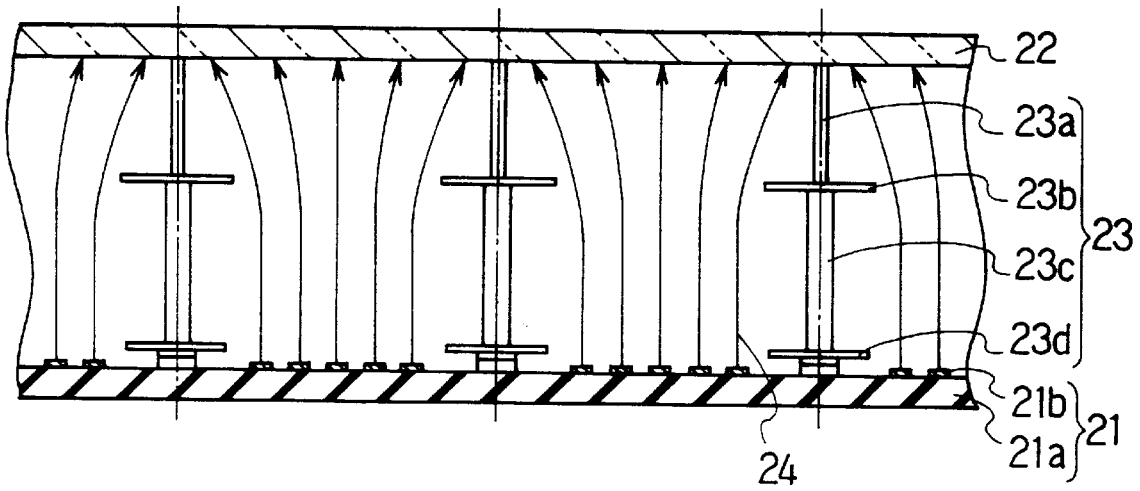
FIG. 5 is a cross-sectional view showing the schematic construction of an image display apparatus in the third embodiment.

FIG. 5 is a cross-sectional view showing the schematic construction of an image display apparatus in the third embodiment. The basic construction of the image display apparatus in this embodiment is the same as that of the second embodiment, except that the structure of the supporting members is distinguishable from the second embodiment.

A supporting member 23 composing the image display apparatus in this embodiment comprises a conductive portion 23*a*, a first electrode portion 23*b*, an insulating portion 23*c*, and a second electrode portion 23*d*. In other words, a first electrode portion 23*b* is formed between the conductive portion 23*a* and the insulating portion 23*c* while the second electrode portion 23*d* is formed at a part ot the insulating portion 23*c* near the electron emission source 21. The first and second electrode portions (23*b*, 23*d*) are formed wider than the insulating portion 23*c*. The second electrode portion 23*d* is basically applied with a predetermined voltage in the range from the anode voltage applied to the fluorescent layer to the voltage at the electron emission source 21 (generally 0V). Voltage can be applied independently to each second electrode portion 23*d* formed at each supporting member 23.

In this embodiment in which the image display apparatus has supporting members 23 comprising the above-mentioned second electrode portions 23*d*, the electron beam acceleration field can be kept constant at a position separated from the insulating portion 23*c*. As the electron beams 24 are sufficiently separated from the supporting member 23, charging of the supporting member 23 (insulating portion 23*c*) caused by the electron beams 24 can be minimized. As some factors such as the extension of the initial speed of the electron beams 24 and the vector of the initial speed of the electron beams 24 can be controlled by controlling the voltage applied to the second electrode portions 23*d* independently, the raster pitches can be controlled while observing the images. That is, the deviation of the beam landing caused by the deviation of the electron sources 21*b* (deviation caused by manufacturing errors or the like) can be corrected easily. As a result, the electron beams 24 can be landed with an equal pitch on the fluorescent layer 22 in a relatively simple manner by controlling some factors such as the positions of the electron sources 21*b* arranged on the insulating substrate 21*a*, the portions and size of the electrode portions 23*b* and 23*d* composing the supporting member 23, and the voltage applied to the second electrode portions 23*d* in an appropriate manner. Therefore, good images can be obtained in the image display apparatus of this embodiment.

Fourth Embodiment

Figure 6:
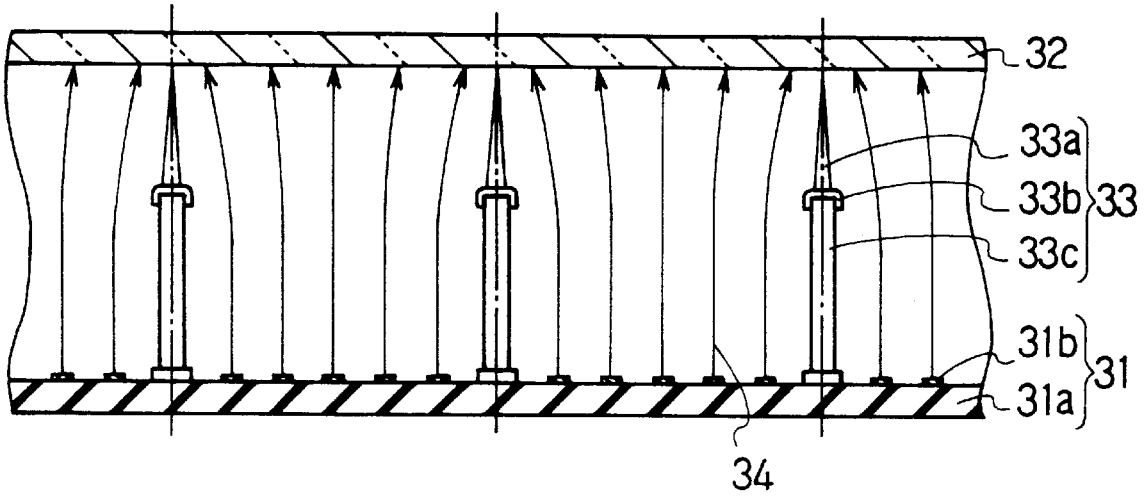
FIG. 6 is a cross-sectional view showing the schematic construction of an image display apparatus in the fourth embodiment.

FIG. 6 is a cross-sectional view showing the schematic construction of an image display apparatus in the fourth embodiment. The basic construction of a display of the embodiment is the same as that of the first embodiment, except that the structure of the supporting members is distinguishable from that of the first embodiment.

A supporting member 33 composing the image display apparatus in this embodiment comprises a conductive portion 33*a*, an electrode portion 33*b* and an insulating portion 33*c*. The supporting member 33 is formed by connecting the conductive portion 33*a* and the insulating portion 33*c* via the electrode portion 33*b*, and sandwiched between the electron emission source 31 and the fluorescent layer 32 so that the conductive portion 33*a* will contact with the fluorescent layer 32 while the insulating portion 33*c* will contact with the electron emission source 31. The conductive portion 33*a* in this embodiment is tapered, that is, this conductive portion 33*a* is shaped thinner at the fluorescent layer 32 side than at the electrode portion 33*b* side. In FIG. 6, numeral 31*a* is an insulating substrate, 31*b* is an electron source, and 34 is an electron beam.

If an image display apparatus comprising conventional supporting members is small, high strength for the supporting members is not required to resist the outside pressure. In such an image display apparatus, the part of a supporting member to contact with the fluorescent layer can be made very small, so that the supporting member will not disturb the image display. However, the stress caused by the outside pressure applied to the panel center is increased as the image display apparatus becomes big, and the image display apparatus should have supporting members with strength to resist the outside pressure. In this case, the supporting member can have quite large cross-section at the electron emission source side, while the cross-section is limited at the fluorescent layer side when considering the influences on the displayed images. The image display apparatus of this invention aims to solve such a problem.

More specifically, an image display apparatus of this embodiment can minimize the no-image display parts generated at the point where the conductive portion 33*a* contacts with the fluorescent layer 32, since the conductive portion 33*a* composing the supporting member 33 is tapered. As a result, good images can be obtained in the image display apparatus of this embodiment.

Fifth Embodiment

An image display apparatus in this embodiment basically has the same construction as that of the fourth embodiment, except for the structure of the supporting members. More specifically, only the construction of the electrode portion is different from that of the fourth embodiment. The electrode portion in this embodiment has the same construction as the electrode portion 13*b* composing the supporting member 13 in the second embodiment referring to FIG. 4.

In other words, the supporting member in this embodiment comprises an electrode portion having the same structure as the electrode portion 13*b* in the second embodiment, a conductive portion having the same structure as the conductive portion 33*a* in the fourth embodiment, and an insulating portion having the same structure as the insulating portion 33*c* in the fourth embodiment. Therefore, this embodiment can provide an image display apparatus possessing the respective advantages of the second and fourth embodiments.

Sixth Embodiment

Figure 7:
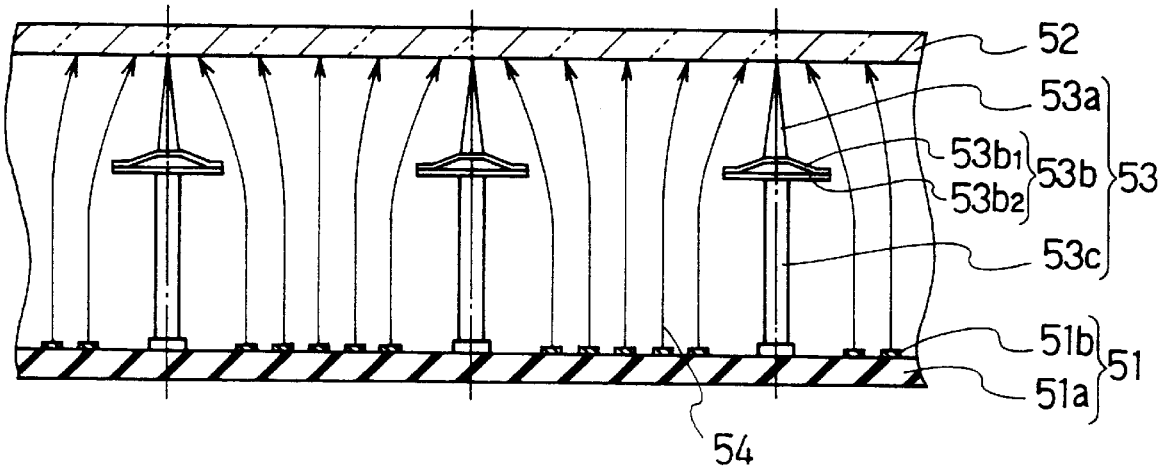
FIG. 7 is a cross-sectional view showing the schematic construction of an image display apparatus in the sixth embodiment.

FIG. 7 is a cross-sectional view showing the schematic construction of an image display apparatus in the sixth embodiment. The image display apparatus in this embodiment basically has the same construction as that in the fifth embodiment, except that the structure of the supporting members is somewhat different, that is, the image display apparatus is formed by using resilient supporting members 53. More specifically, the image display apparatus in this embodiment is different from the fifth embodiment only in the structure of electrode portions 53*b* composing the supporting members 53.

An electrode portion 53*b* composing a supporting member 53 in the embodiment comprises a first electrode component 53$b_1$, contacting with a tapered conductive portion 53*a*, and a second electrode component 53$b_2$ contacting with an insulating portion 53*c*. The electrode portion 53*b* is a trapezoid whose side lines are equal when viewed in the cross section, and it is formed by deforming to some extent at least one of the electrode components in order to provide a predetermined space between the first electrode component 53$b_1$, and second electrode component 53$b_2$ and sticking the first and second electrode components (53$b_1$, and 53$b_2$) together. In this embodiment, the first electrode component 53$b_1$, is deformed to have a predetermined shape before sticking the flat second electrode component 53$b_2$ to this first electrode component 53$b_1$, so that an electrode portion 53*b* having a predetermined space between the first electrode component 53$b_1$, and the second electrode portion 53$b_2$ is formed. As a result, the electrode portion 53*b* has a predetermined space as mentioned above, and the first electrode component 53$b_1$ has flexibility for the space. Therefore, the supporting member 53 formed with the electrode portion 53*b* will have a predetermined resilience. In FIG. 7, 51*a* is an insulating plate, 51*b* is an electron source, and 54 is an electron beam.

In this embodiment in which an image display apparatus is formed by using the supporting members 53, the electrode portions 53*b* with a predetermined resilience will function as a buffer even if the conductive portions 53*a* or the insulating portions 53*c* both composing the supporting members 53 are varied in length, therefore, the electrode portions 53*b* will compensate the variation in length of the members and maintain the flatness of the image display apparatus. As a result, the stress is prevented from being focused on one point, and thus, distortions or cracking in an image display apparatus can be prevented.

Figure 8:
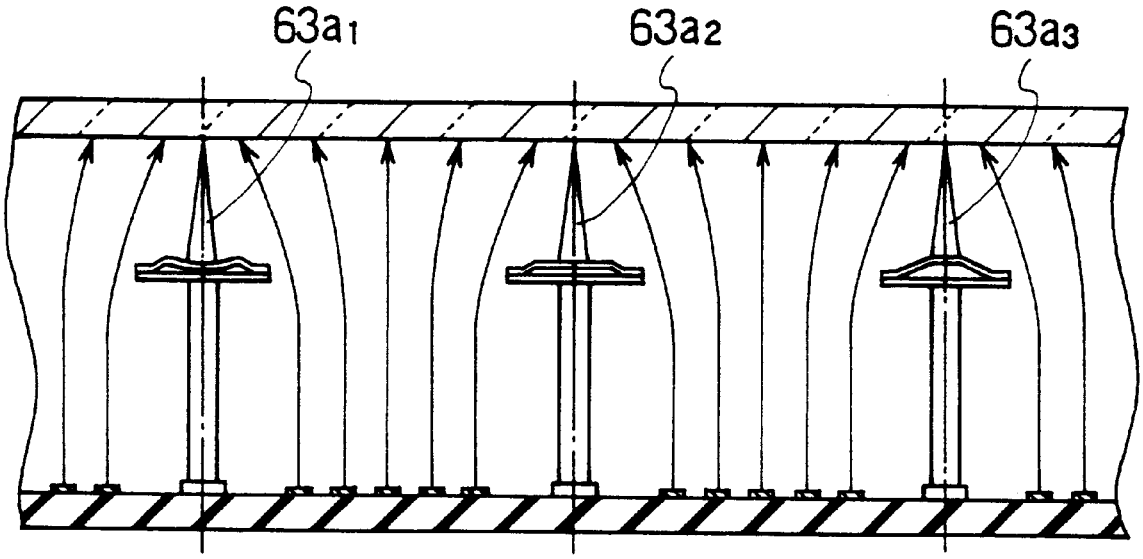
FIG. 8 is a cross-sectional view showing the deformation of the electrode portions composing the image display apparatus shown in FIG. 7.

FIG. 8 shows a variation of the supporting members (electrode portions) in this embodiment when the conductive portions composing the supporting members are varied in length. In FIG. 8, a left-side conductive portion (hereinafter, left conductive portion) 63$a_1$, is formed to be the longest. The second longest is the central conductive portion 63$a_2$, and the right-side conductive portion 63$a_3$ (right conductive portion) is the shortest one. That is, the left conductive portion 63$a_1$, is longer and the right conductive portion 63$a_3$ is shorter when the length of the central conductive portion 63$a_2$ is decided to be the design value.

As clearly shown in FIG. 8, electrode portions that are previously provided with predetermined spaces (in this case, a predetermined space is formed so that the first electrode component is somewhat deformed when an image display apparatus is formed by using the conductive portions with a design value) will compensate for the varied length of the conductive portions (63$a_1$, 63$a_2$, and 63$a_3$,) even if the conductive portions are differentiated from each other in length. Thus, the strength of the image display apparatus is improved.

Figure 9:
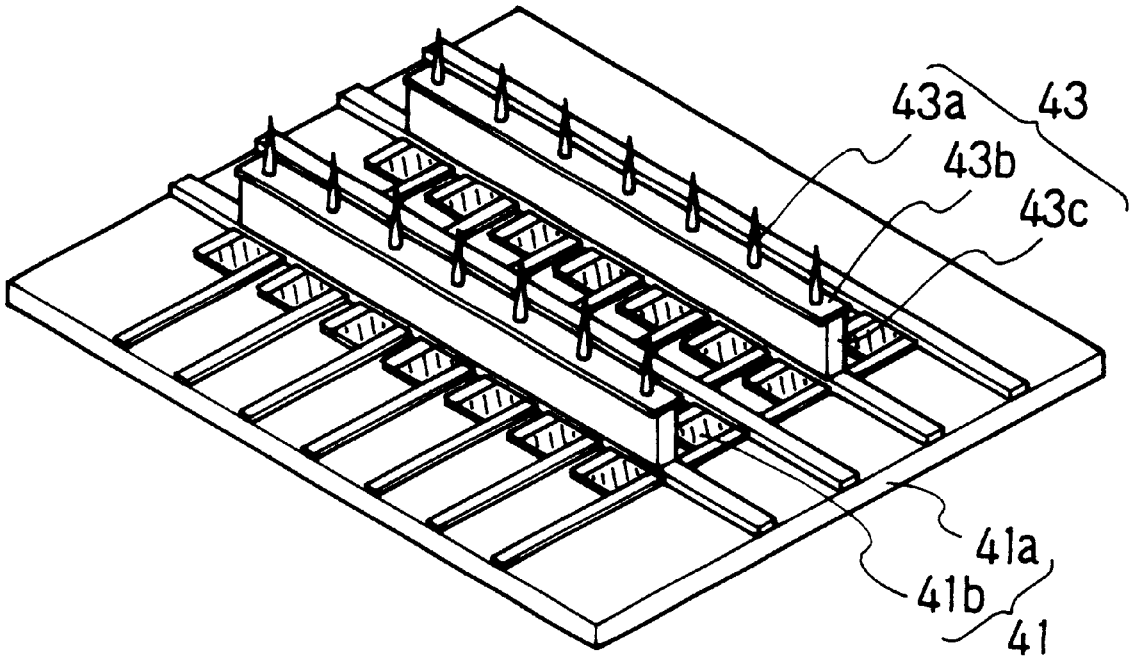
FIG. 9 is a perspective view showing another construction of the supporting member used in the latter embodiments including the fourth embodiment.

The supporting members described in the fourth or latter embodiments have tapered conductive portions, and the conductive portions are plates extended in the transverse direction. A supporting member of this invention, however, will not be limited to this but it can be formed by separating the columnar supporting members from each other. Taking the productivity of an image display apparatus into consideration, however, it is extremely difficult to form many supporting members individually. Therefore, as shown in FIG. 9, a supporting member 43 can be formed by shaping only the conductive portions 43*a* to be acicular while the electrode portion 43*b* and insulating portion 43*c* are made of plate members.

The construction can prevent the images from being shielded by the supporting members on the image screen, and in particular, the strength of the image display apparatus can be improved by combining supporting members having resilient insulating portions, since the outside pressure will be received uniformly by the entire screen.

Seventh Embodiment

Figure 10:
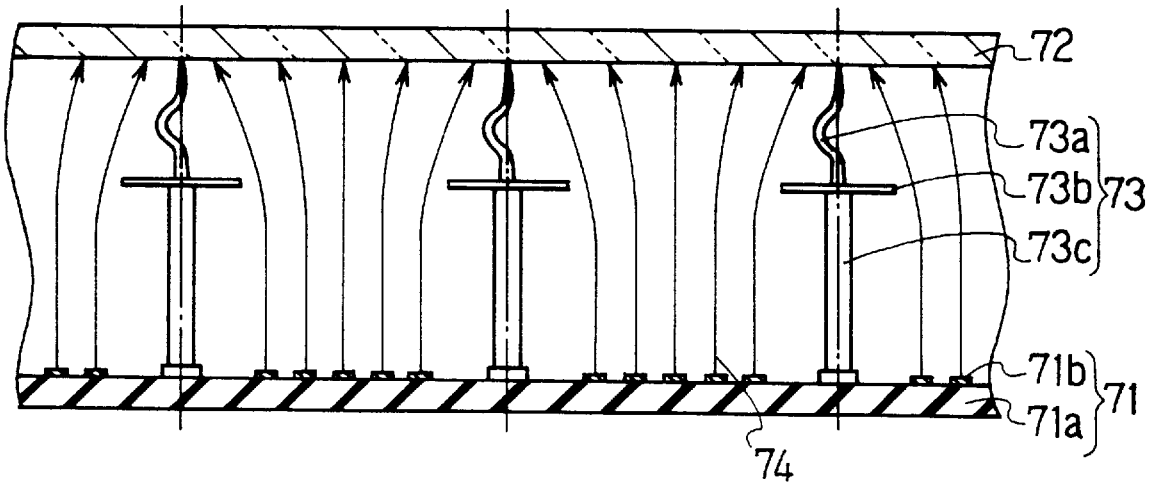
FIG. 10 is a cross-sectional view showing the schematic construction of an image display apparatus in the seventh embodiment.

FIG. 10 is a cross-sectional view showing the schematic construction of an image display apparatus in the seventh embodiment. The image display apparatus in this embodiment basically has the same construction as the image display apparatus in the fifth embodiment, except that the structure of the supporting members is somewhat different, that is, the image display apparatus in this embodiment is formed by using resilient supporting members 73. More specifically, the image display apparatus in this embodiment is different from that in the fifth embodiment only in the structure of conductive portions 73*a* composing the supporting members 73.

A conductive portion 73*a* composing a supporting member 73 in this embodiment is formed to be a predetermined shape (curved) as shown in FIG. 10. The conductive portion 73*a* has some flexibility because of the curved shape. Therefore, the supporting member 73 comprising the conductive portion 73*a* will have a predetermined resilience. In FIG. 10, 71*a* is an insulating substrate, 71*b* is an electron source, and 71 is an electron emission source composed thereof. Numeral 74 is an electron beam.

An image display apparatus in this embodiment comprises the abovementioned supporting members 73. Therefore, the conductive portion 73*a* with a predetermined resilience functions as a buffer even if either the electrode portions 73*b* or the insulating portions 73*c* of the supporting members 73 are varied in length (thickness). As a result, the variation in length of the members will be compensated and the stress can be prevented from being focused on a point.

The sixth embodiment refers to a case for forming resilient supporting members by using electrode portions having a predetermined flexibility, while the seventh embodiment refers to a case for forming resilient supporting members by using conductive portions having a predetermined flexibility. This invention is not limited to these constructions, but for example, resilient supporting members can be formed by using insulating portions having a predetermined flexibility or by using electrode portions and conductive portions having flexibility.

In this invention, the embodiments mentioned above can be combined respectively. Therefore, an image display apparatus formed by combining the embodiments will show the combined effects of respective embodiments.

Figure 11:
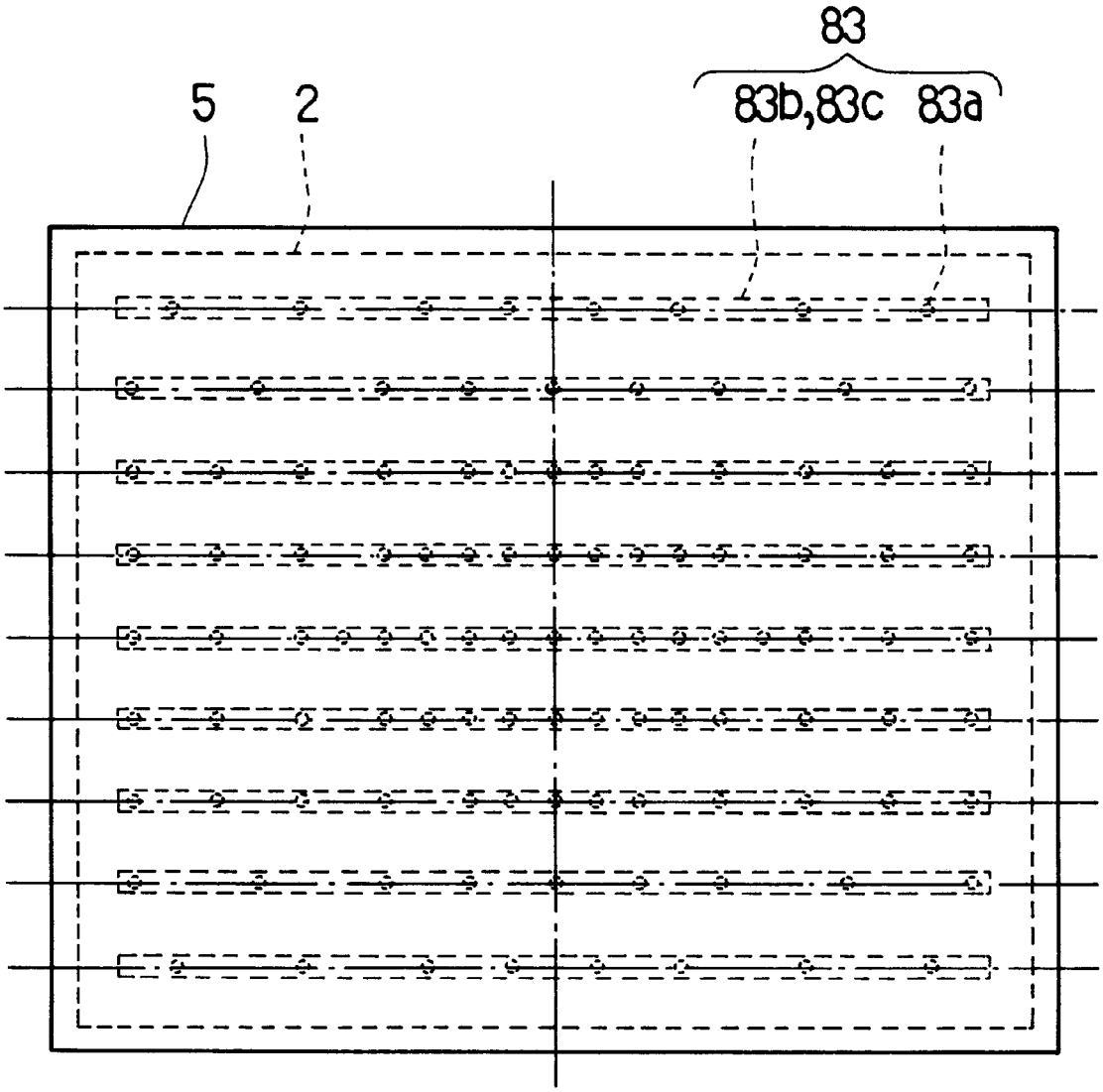
FIG. 11 is a plan view showing an example of an image display apparatus in which supporting members are arranged with a higher density at the center of the screen.
Figure 12:
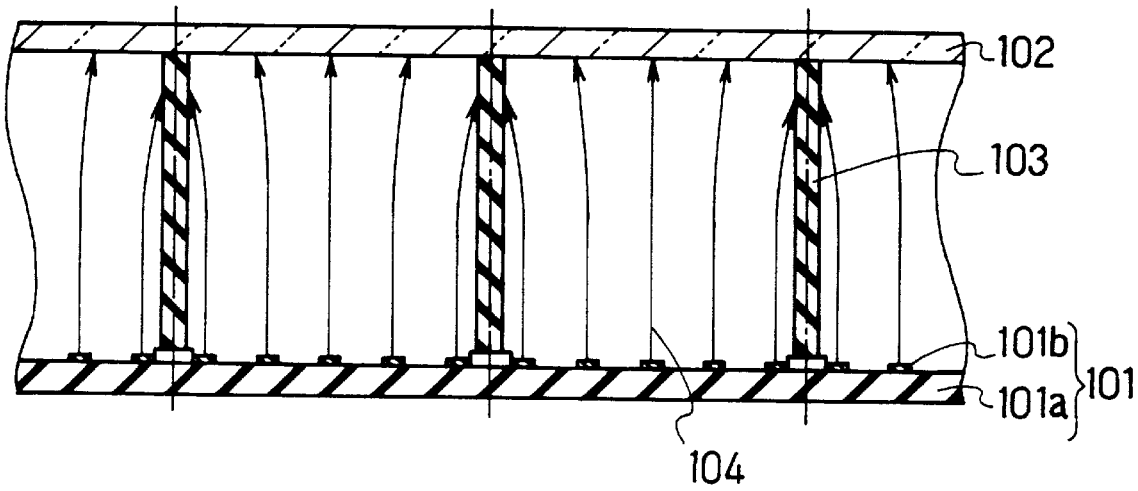
FIG. 12 PRIOR ART
FIG. 12 is a cross-sectional view showing the schematic construction of a conventional image display apparatus.
Figure 13:
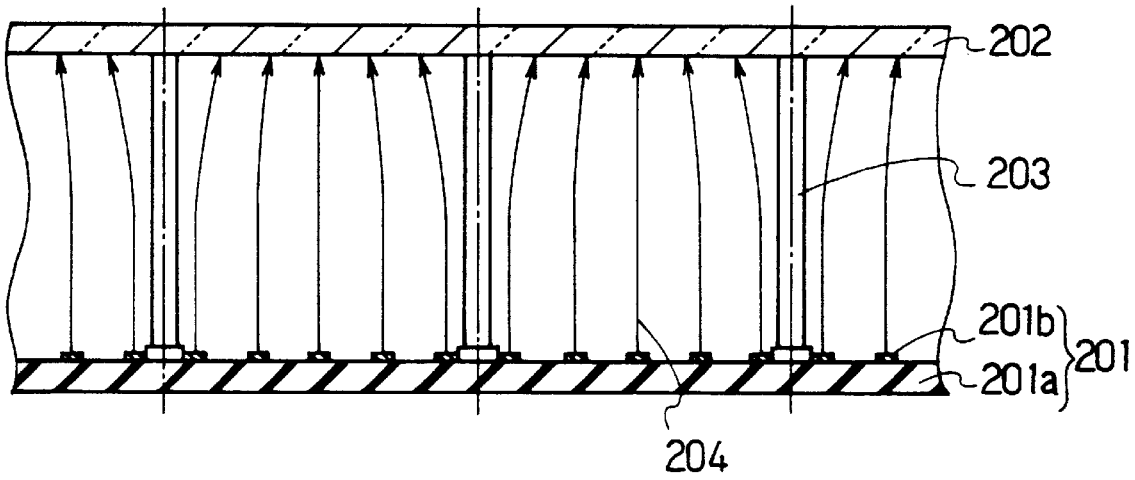
FIG. 13 PRIOR ART
FIG. 13 is a cross-sectional view showing the schematic construction of another conventional image display apparatus.

Though supporting members are arranged uniformly inside the image display apparatuses in the above embodiments, this invention is not limited thereto. The supporting members in the embodiments, for example, can be arranged with a higher density at the center of the screen of a image display apparatus. FIG. 11 is a plan view showing one example of the construction. A supporting member 83 in FIG. 11 comprises a plate-like insulating portion 83*c* on which an electrode portion 83*b* and columnar conductive portions 83*a* are formed sequentially. The conductive portions 83*a* are arranged with a higher density at the center of the screen. In such an image display apparatus, the total reaction force of the supporting members 83 can be made greater at the screen center to which higher stress will be applied to, and thus, the atmospheric pressure and the stress can be balanced.

In the above embodiments, the image display apparatuses are formed by containing electron emission sources, fluorescent layers, and supporting members in vacuum containers. This invention is not limited thereto, but an image display apparatus of this invention can be produced, for example, by forming between an electron emission source and a fluorescent layer, electrodes functioning to deflect electron beams emitted from electron emission sources, electrodes functioning to focus electron beams, or electrodes functioning to focus and deflect electron beams. Image display apparatuses formed in this way can resist the atmospheric pressure and provide images with a high resolution property.

The invention may be embodied in other forms without departing from the spirit or essential characteristics thereof. The embodiments disclosed in this application are to be considered in all respects as illustrative and not limitative, the scope of the invention is indicated by the appended claims rather than by the foregoing description, and all changes which come within the meaning and range of equivalency of the claims are intended to be embraced therein.

What is claimed is:

1. An image display apparatus comprising: a fluorescent layer formed on an inner surface of a vacuum container whose interior is kept under vacuum, an electron emission source comprising an insulating substrate provided with electron sources arranged thereon, and a supporting member sandwiched between the fluorescent layer and the electron emission source, and a displacement preventing system to prevent displacement of electron beams emitted from the electron sources caused by the charging of the supporting member, wherein the displacement preventing system comprises a conductive portion provided at a part of the supporting member near the fluorescent layer, the conductive portion being in contact with the fluorescent layer; and wherein the supporting member has an electrode portion at a position between the electron emission source and the conductive portion, the electrode portion being in contact with the conductive portion, and has an insulating portion between the electron emission source and the electrode portion.

2. The image display apparatus according to claim 1, wherein the electron sources are divided and arranged in a matrix.

3. The image display apparatus according to claim 2, wherein the electron sources are arranged on the insulating substrate so that the electron beams emitted from the electron sources are landed on the fluorescent layer with an equal pitch.

4. The image display apparatus according to claim 1, wherein the electrode portion is formed to be wider than the insulating portion.

5. The image display apparatus according to claim 4, wherein a second electrode portion formed wider than the insulating portion is provided at the insulating portion near the electron emission source.

6. The image display apparatus according to claim 5, wherein voltage is applied independently to a plurality of the second electrode portions.

7. The image display apparatus according to claim 1, wherein the conductive portion is tapered and the part of the conductive portion contacting with the fluorescent layer is formed narrower than the part at the opposite side.

8. The image display apparatus according to claim 1, wherein the supporting member is resilient.

9. The image display apparatus according to claim 1, wherein the electrode portion is resilient.

10. The image display apparatus according to claim 1, wherein the conductive portion is resilient.

11. The image display apparatus according to claim 1, wherein the insulating portion is resilient.

12. The image display apparatus according to claim 1, wherein the supporting members are arranged with a higher density at a center part of the fluorescent layer.

13. An image display apparatus comprising: a fluorescent layer formed on an inner surface of a vacuum container whose interior is kept under vacuum, an electron emission source comprising an insulating substrate provided with electron sources arranged thereon, a resilient supporting member sandwiched between the fluorescent layer and the electron emission source, and a displacement preventing system to prevent displacement of electron beams emitted from the electron sources caused by the charging of the supporting member.

14. An image display apparatus comprising: a fluorescent layer formed on an inner surface of a vacuum container whose interior is kept under vacuum, an electron emission source comprising an insulating substrate provided with electron sources arranged thereon, supporting members that are sandwiched between the fluorescent layer and the electron emission source and are arranged with a higher density at a center part of the fluorescent layer, and a displacement preventing system to prevent displacement of electron beams emitted from the electron sources caused by the charging of the supporting member.

15. The image display apparatus according to claim 14, wherein the supporting member is resilient.

* * * * *